US005732617A

United States Patent [19]

Lollini

[11] Patent Number: 5,732,617

[45] Date of Patent: Mar. 31, 1998

[54] APPARATUS FOR BALING MUNICIPAL SOLID WASTE

[75] Inventor: Alessandro Lollini, Bologna, Italy

[73] Assignee: Lollii International S.p.A., Quarto Inferiore, Italy

[21] Appl. No.: 768,603

[22] Filed: Dec. 18, 1996

[30] Foreign Application Priority Data

Jan. 4, 1996 [IT] Italy ..... BO96A0006

[51] Int. Cl.[6] ..... B30B 9/30; B30B 7/04; B65B 13/20

[52] U.S. Cl. ..... 100/7; 100/99; 100/215; 100/232; 100/233; 100/249

[58] Field of Search ..... 100/3, 7, 18, 26, 100/45, 99, 215, 232, 233, 249, 901

[56] References Cited

U.S. PATENT DOCUMENTS

| | | | |
|---|---|---|---|
| 1,026,987 | 5/1912 | Kardos | 100/249 |
| 2,932,244 | 4/1960 | Moyer | 100/901 |
| 3,266,096 | 8/1966 | Thomas et al. | 100/232 |
| 3,545,369 | 12/1970 | Tokushima | 100/233 |
| 3,564,993 | 2/1971 | Tezuka | 100/232 |
| 3,965,812 | 6/1976 | Oberg | 100/249 |
| 4,040,230 | 8/1977 | Pessel et al. | 100/99 |
| 4,201,129 | 5/1980 | Matthys | 100/233 |
| 4,337,694 | 7/1982 | Brown | 100/45 |
| 4,476,779 | 10/1984 | Hasebe et al. | 100/3 |
| 4,594,942 | 6/1986 | Denneboom | 100/233 |
| 4,787,308 | 11/1988 | Newsom et al. | 100/45 |
| 4,936,206 | 6/1990 | Miles et al. | 100/3 |
| 4,961,375 | 10/1990 | Weder et al. | 100/45 |
| 5,201,266 | 4/1993 | Schmaltz et al. | 100/232 |

FOREIGN PATENT DOCUMENTS

| | | | |
|---|---|---|---|
| 4207025 | 9/1993 | Germany | 100/3 |
| 46-12197 | 3/1971 | Japan | 100/901 |
| 55-136599 | 10/1980 | Japan | 100/99 |
| 3-293201 | 12/1991 | Japan | 100/232 |
| 969330 | 9/1964 | United Kingdom | 100/232 |
| 1384080 | 2/1975 | United Kingdom | 100/3 |

*Primary Examiner*—Stephen F. Gerrity
*Attorney, Agent, or Firm*—Guido Modiano; Albert Josif

[57] ABSTRACT

An apparatus for baling municipal solid waste, characterized in that it comprises a waste compacting press composed of a compartment, which encloses a chamber, and is provided, in an upward region, with an opening for loading the loose waste, and is laterally provided with an axial opening for discharging the compacted waste; the upper opening is closeable by two articulated covers, subjected to the action of two pusher jacks to apply a pre-compaction pressure to the waste fed into the chamber, and the axial opening can be closed by a door against which the waste is compacted, so as to form a prism-like bale, by an axial jack, with an action line perpendicular to the door; the door can be removed to clear the axial opening and transfer the bale from the chamber into a sorting channel, whereat a pusher element advances the bale through a strapping machine adapted to place straps around the bale.

4 Claims, 3 Drawing Sheets

APPARATUS FOR BALING MUNICIPAL SOLID WASTE

BACKGROUND OF THE INVENTION

The present invention relates to an apparatus for baling municipal solid waste.

It is known that municipal solid waste entails severe disposal problems.

SUMMARY OF THE INVENTION

The aim of the present invention is to solve this problem by proposing an apparatus allowing conversion of municipal solid waste, after appropriate screening treatments, into bales having such a shape and consistency that they can constitute a material usable as a source of energy, particularly as fuel for furnaces.

Within the scope of this aim, an object of the present invention is to provide an apparatus allowing production of bales adapted for rotary kilns in cement plants.

This aim and this object are achieved by an apparatus for baling municipal solid waste, characterized in that it comprises a waste compacting press composed of a compartment enclosing a chamber, and which is provided, in an upward region, with an opening for loading the loose waste, and, laterally, with an axial opening for discharging the compacted waste, said upper opening being closeable by means of two articulated covers subjected to the action of two pusher jacks to apply a pre-compaction pressure to the waste fed into said chamber, said axial opening being closeable by means of a door against which the waste is compacted, so as to form a prism-like bale, by an axial jack, with an action line perpendicular to said door, said door being removable to clear said axial opening and allowing transfer of said bale from said chamber into a sorting channel, whereat a pusher element is provided that advances said bale through a strapping machine that is adapted to place straps around said bale.

BRIEF DESCRIPTION OF THE DRAWINGS

Further characteristics and advantages of the present invention will become apparent from the following description of a preferred embodiment, illustrated only by way of non-limitative example in the accompanying drawings, wherein.

DESCRIPTION OF THE PREFERRED EMBODIMENTS

Figure 1:
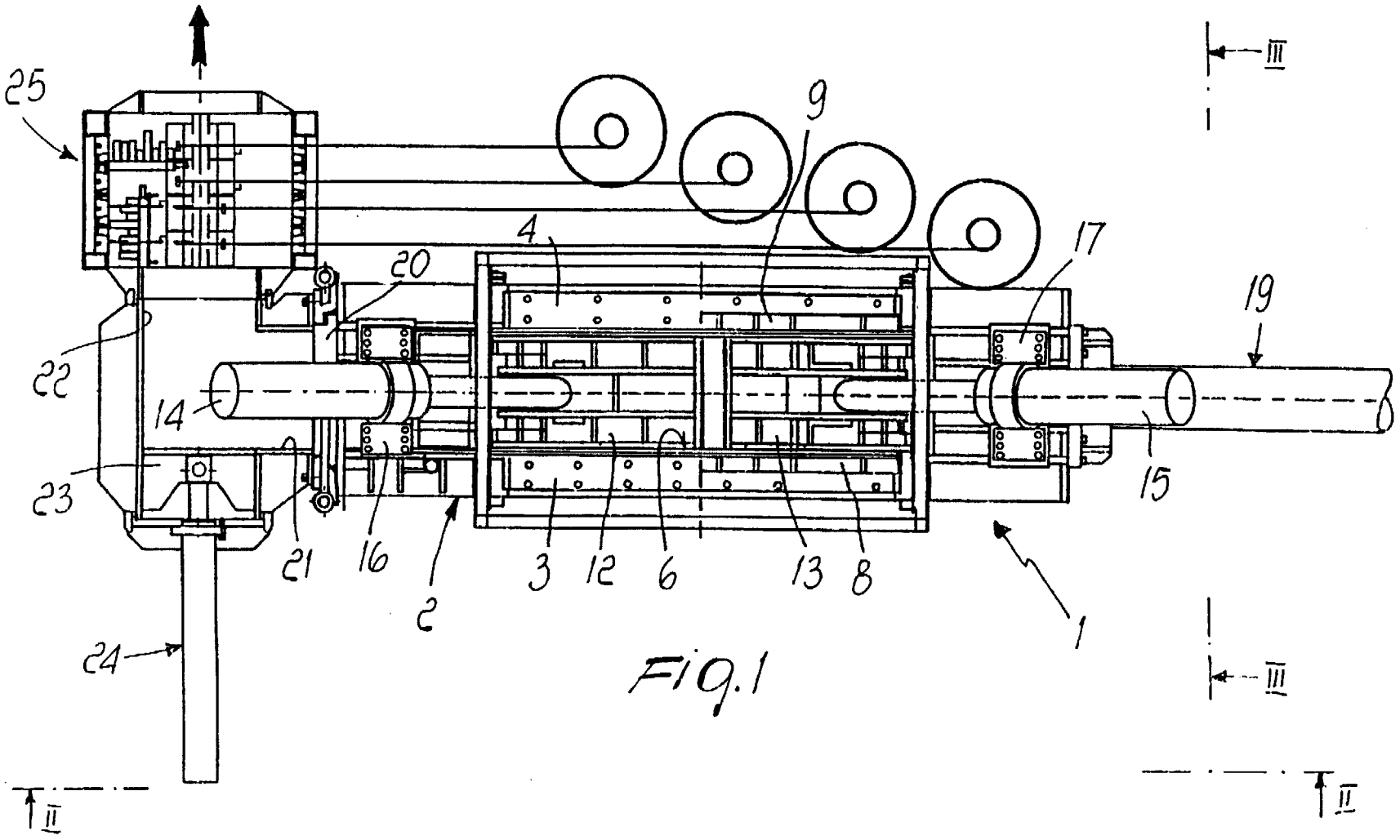
FIG. 1 is a top view of the apparatus.
Figure 2:
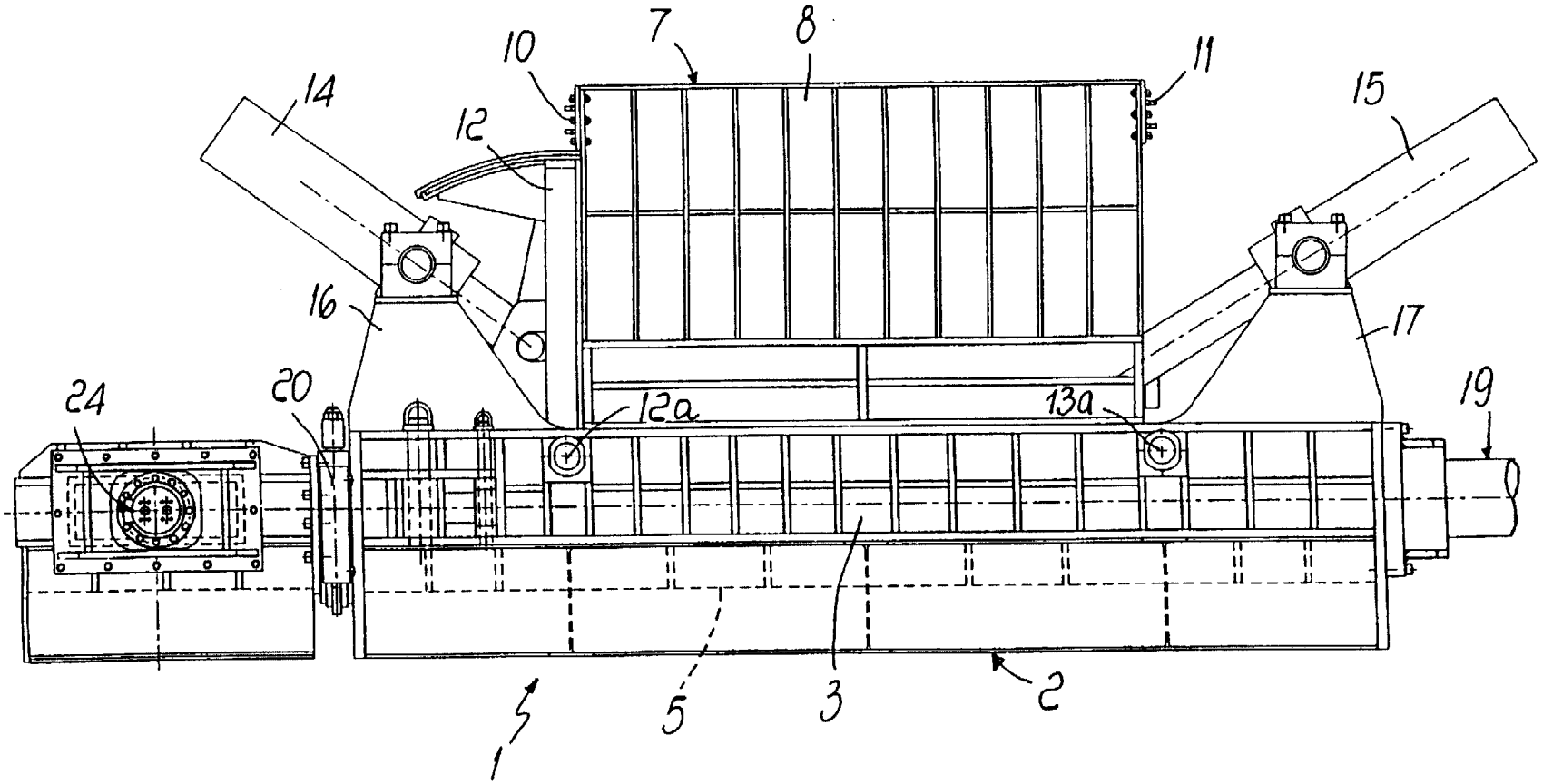
FIG. 2 is an elevation view, taken in the direction II—II of FIG. 1.
Figure 3:
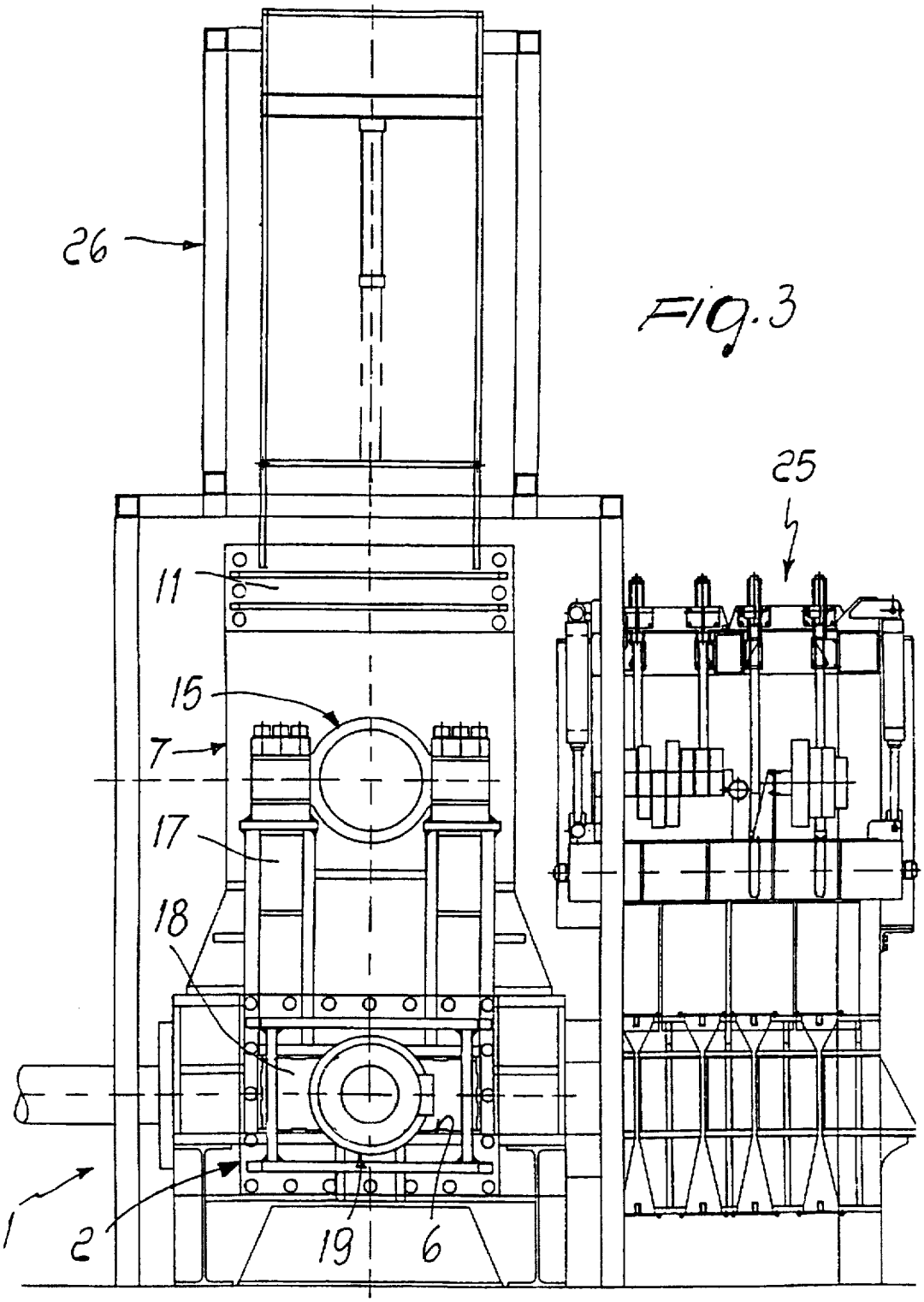
FIG. 3 is an elevation view, taken in the direction III—III of FIG. 1.

With reference to the above figures, the apparatus comprises a press, generally designated by the reference numeral 1, which is composed of a compaction compartment 2 with two longitudinal walls 3 and 4 rising from a bottom 5 and delimiting a waste collecting chamber. The chamber is connected, through an upper opening, to a waste loading hopper 7. The hopper 7 comprises two walls 8 and 9 that rise in a co-planar fashion from the walls 3 and 4 and are interconnected at the top by cross-members 10 and 11.

The cross-members 10 and 11, together with the walls 8 and 9, delimit openings through which respective covers 12 and 13 rotate; said covers are hinged about axes **12*a* and 13*a* in the walls 3 and 4**.

The covers 12 and 13 are actuated by respective jacks 14 and 15 between a substantially vertical position, where they form the transverse walls of the hopper 7, and a horizontal position inside the hopper, where they close the chamber of the compaction compartment 2 in an upward region. The jacks 14 and 15 are articulated in supports 16 and 17 rising from the opposite ends of the longitudinal walls.

A pusher plate 18 moves inside the compartment 2 and is connected to the stem of an axial jack 19 coupled by means of a flange to one end of the compartment.

A door 20 for controlling an axial opening of the compartment is arranged on the opposite side of the compartment 2 opposite to the plate 18; the waste is compacted against said door by the jack 19, as will become apparent hereinafter.

Accordingly, the door 20 has a sturdy structure, in order to withstand the enormous compaction thrusts, and it can be removed to allow the waste, by then compacted so as to form a bale, to access a region known as the sorting region.

The sorting region is constituted by an L-shaped channel with a portion 21 aligned with the press 1 and a portion 22 perpendicular to the portion 21.

A pusher 23 is aligned with the portion 22, is actuated by a horizontal jack 24 lying at right angles to the axis of the jack 19, and allows for transfer of the bale arriving from the press into a conventional strapping machine 25 which as such is not shown in detail. In the illustrated example the strapping machine 25 is constituted by four strapping units capable of applying four straps to the material. The number of straps may of course vary from four to seven according to the requirements.

The operation of the apparatus is as follows; the waste, optionally subjected to preliminary screening and fed directly by the means of transport or by a conveyor, is discharged into the hopper 7, through which it accesses the chamber 6 of the compaction compartment 2 since the covers 12 and 13 are in raised condition.

By actuating the jacks 14 and 15, the waste undergoes a first compaction in the compartment 2 by means of the covers 12 and 13.

Then the axial jack 19 is actuated, compacting the waste against the door 20, so as to form a bale that is compact enough not to flake. The resulting bale, after the lifting of the door 20, is transferred along the channel 21 by the further stroke of the axial jack 19 until it is in front of the pusher 23, which then pushes the bale along the channel 22 into the strapping machine to fit the straps.

Each bale pushed into the strapping machine 25 expels the previously strapped one from said machine.

It is evident that the invention fully achieves the intended aims and objects.

In particular, the apparatus allows bales having constant measurements and densities to be obtained so as to be handled to allow stacking, handling in store-yards, and facilitate palletization, transport, and kiln feeding.

Numerous modifications and variations are possible in the practical embodiment of the invention, and all are within the scope of the same inventive concept.

Conveniently, a weighing system 26 is associated above the hopper and comprises a container receiving the loose waste and having a bottom that can be opened pneumatically to discharge the waste into the underlying press. The preliminary weighing of the material allows for introduction into the press 2 of an amount of material having a constant weight and therefore to form bales having a constant calorific value.

Advantageously, the chamber of the compartment 2 is covered with wear-resistant steel; furthermore, the internal surfaces of the compartment and the pusher plate have fretted patterns to prevent pieces of material from jamming between the pusher plate and the compartment.

What is claimed is:

1. An apparatus for baling municipal solid waste comprising:

a waste compacting press being composed of a compartment, a chamber enclosed in said compartment, an upper opening for loading loose waste being provided in an upward region of said compartment, an axial opening provided laterally to said chamber for discharging compacted waste, two articulated covers for closing said upper opening, two pusher jacks for actuating said articulated covers to apply a pre-compaction pressure to waste fed into said chamber, a door for closing said axial opening and against which the waste is compacted, and an axial jack for compacting the waste against said door to form prism-shaped bales of waste;

a sorting channel operatively connected with said chamber, said door being removable for clearing said axial opening and allowing transfer of said waste bale from said chamber into said sorting channel;

a strapping machine for placing straps around said waste bale; and a pusher element acting at said sorting channel for advancing said waste bale through said strapping machine.

2. Apparatus according to claim 1, comprising a hopper for conveying the waste into said chamber, said hopper being arranged above said compartment.

3. Apparatus according to claim 2, comprising a weighing system being associated with said hopper, said weighing system comprising a waste receiving container, said receiving container having a bottom that can be opened pneumatically, when a preset weight is reached, to discharge the waste into said underlying press.

4. Apparatus according to claim 1, wherein said articulated covers are actuatable by said respective jacks between a vertical position for facilitating introduction of waste in said chamber, and a horizontal position for closing said chamber and pre-compacting the introduced waste.

* * * * *

UNITED STATES PATENT AND TRADEMARK OFFICE

CERTIFICATE OF CORRECTION

PATENT NO. : 5,732,617

DATED : March 31, 1998

INVENTOR(S) : Alessandro Lollini

It is certified that error appears in the above-indentified patent and that said Letters Patent is hereby corrected as shown below:

On the title page, item [73] Assignee: should read --LOLLINI INTERNATIONAL S.p.A.--.

Signed and Sealed this

Twenty-fifth Day of August, 1998

Bruce Lehman

*Attest:*

BRUCE LEHMAN

*Attesting Officer*

*Commissioner of Patents and Trademarks*